US008649698B2

(12) United States Patent
Namiki et al.

(10) Patent No.: US 8,649,698 B2
(45) Date of Patent: Feb. 11, 2014

(54) IMAGE FORMING APPARATUS CONTROLLING POWER TO A HEATING UNIT FORMING A FIXING NIP PORTION WITH A PRESSURE ROLLER THROUGH WHICH A RECORDING SHEET IS CONVEYED TO FIX A TONER IMAGE THEREON

(75) Inventors: Teruhiko Namiki, Mishima (JP); Hiromitsu Kumada, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 402 days.

(21) Appl. No.: 12/706,918

(22) Filed: Feb. 17, 2010

(65) Prior Publication Data

US 2010/0215391 A1 Aug. 26, 2010

(30) Foreign Application Priority Data

Feb. 20, 2009 (JP) ..... 2009-037778
Feb. 3, 2010 (JP) ..... 2010-022100

(51) Int. Cl.
*G03G 15/20* (2006.01)

(52) U.S. Cl.
USPC ..... 399/70

(58) Field of Classification Search
USPC ..... 399/69, 70, 329
See application file for complete search history.

(56) References Cited

U.S. PATENT DOCUMENTS

| | | | | |
|---|---|---|---|---|
| 5,109,255 | A * | 4/1992 | Nishikawa et al. | 399/70 |
| 5,220,389 | A * | 6/1993 | Kishimoto et al. | 399/69 |
| 7,054,573 | B2 * | 5/2006 | Hirai et al. | 399/70 |
| 7,155,136 | B2 | 12/2006 | Nihonyanagi et al. | |
| 7,386,244 | B2 * | 6/2008 | Otsuka | 399/69 |
| 7,454,151 | B2 * | 11/2008 | Satoh et al. | 399/69 |
| 2004/0131375 | A1 * | 7/2004 | Lee | 399/69 |

FOREIGN PATENT DOCUMENTS

| | | |
|---|---|---|
| JP | 2002-043048 | 2/2002 |
| JP | 2002-231428 | 8/2002 |
| JP | 2005-250453 | 9/2005 |
| JP | 2006-098998 | 4/2006 |

* cited by examiner

*Primary Examiner* — Sandra Brase
(74) *Attorney, Agent, or Firm* — Fitzpatrick, Cella, Harper & Scinto

(57) ABSTRACT

The image forming apparatus includes an image forming unit, a fixing part and a controller controlling power to be supplied to the heating unit so as to keep the temperature of the heating unit at a control target temperature. When the fixing process is ended, in a standby-mode, the supply of power to the heating unit is started to keep the temperature of the heating unit at the control target temperature, and the start time of the supply of power to the heating unit is set to a time when the temperature of the heating unit is lowered to a predetermined temperature lower than the control target temperature, thereby reducing the power consumption of the image forming apparatus in the standby-mode.

10 Claims, 7 Drawing Sheets

IMAGE FORMING APPARATUS CONTROLLING POWER TO A HEATING UNIT FORMING A FIXING NIP PORTION WITH A PRESSURE ROLLER THROUGH WHICH A RECORDING SHEET IS CONVEYED TO FIX A TONER IMAGE THEREON

BACKGROUND OF THE INVENTION

1. Field of the Invention

The present invention relates to an image forming apparatus which performs a preliminary heating operation for keeping the temperature of a fixing device equal to or greater than a predetermined temperature in a standby-mode where an image forming request is waited for.

2. Description of the Related Art

An increase in the speed and the number of colors used in an image forming apparatus such as a copier or a printer has been accomplished in recent years. In such a high-speed printer or color printer, a control target temperature of a fixing device should be set high at the time of fixing a toner image formed on a recording sheet by heating. In such a high-speed printer or color printer, the power consumption in parts other than the fixing device in the apparatus is great and the power which can be assigned to the fixing device decreases. When the power to be assigned to the fixing device decreases, the time period increases until the fixing device rises to a temperature at which an image on the recording sheet is fixed after an image forming request is input to the apparatus.

However, the time period until a first recording sheet is discharged after the image forming request is input, that is, a so-called first printout time (hereinafter, referred to as "FPOT"), should be as short as possible. Accordingly, as described in Japanese Patent Application Laid-Open No. 2006-98998, a method may be employed in which the power consumption for starting up the fixing device to a fixable state, in which an unfixed image on the recording medium can be fixed, is reduced without lengthening the FPOT by warming the fixing device to some extent in a standby-mode to wait for a request of an image forming operation. The time period until the temperature of the fixing device rises to the fixable temperature after the image forming request is input greatly depends on the temperatures of other elements of the fixing device, particularly, the temperature of a pressure roller, as well as the temperature of a heating unit. However, in the image forming apparatus according to the related art in which a control of warming the fixing device in the standby-mode is made, it is controlled to keep the temperature of the heating unit at the control target temperature in the standby-mode as soon as possible, when the temperature of the heating unit falls to the control target temperature in the standby-mode just after a printing operation is ended and the operation mode is switched to the standby-mode. In the apparatus for controlling warming of the fixing device in the standby-mode, much power is consumed and it is thus preferable that the power consumption be suppressed as much as possible even in the standby-mode. However, Applicants have found that the power consumption in the standby-mode can be further suppressed in the above-mentioned control.

SUMMARY OF THE INVENTION

The invention is contrived in consideration of the above-mentioned problem and an object thereof is to reduce the power consumption of the image forming apparatus in the standby-mode without sacrificing the FPOT.

According to an aspect of the invention, a purpose of the invention is to provide an image forming apparatus including an image forming part that forms a toner image on a recording sheet, and a fixing part that heats the toner image formed on the recording sheet to fix the toner image onto the recording sheet. The fixing part includes a heating unit and a pressure roller that comes in contact with the heating unit to form a fixing nip portion through which the recording sheet is conveyed. The apparatus also includes a controller that controls power to be supplied to the heating unit so as to keep the temperature of the heating unit at a control target temperature. In a case where a new image is not formed after a fixing process is performed for the recording sheet bearing the toner image, the image forming apparatus switches to a standby mode to wait for a request for an image forming operation, and the controller sets the control target temperature to be lower than a temperature in the fixing process to control the supply of power to the heating unit in the standby mode. In a case where the supply of power to the heating unit is started to keep the temperature of the heating unit at the control target temperature in the standby mode after the fixing process is ended and the image forming apparatus has switched to the standby mode, a start time of the supply of power to the heating unit is set to a time when the temperature of the heating unit is lowered to a predetermined temperature lower than the control target temperature in the standby-mode.

Further purpose of the present invention will become apparent from the following description of exemplary embodiments with reference to the accompanied drawings.

DESCRIPTION OF THE EMBODIMENTS

Preferred embodiments of the present invention will now be described in detail in accordance with the accompanying drawings.

First Embodiment

Figure 1:
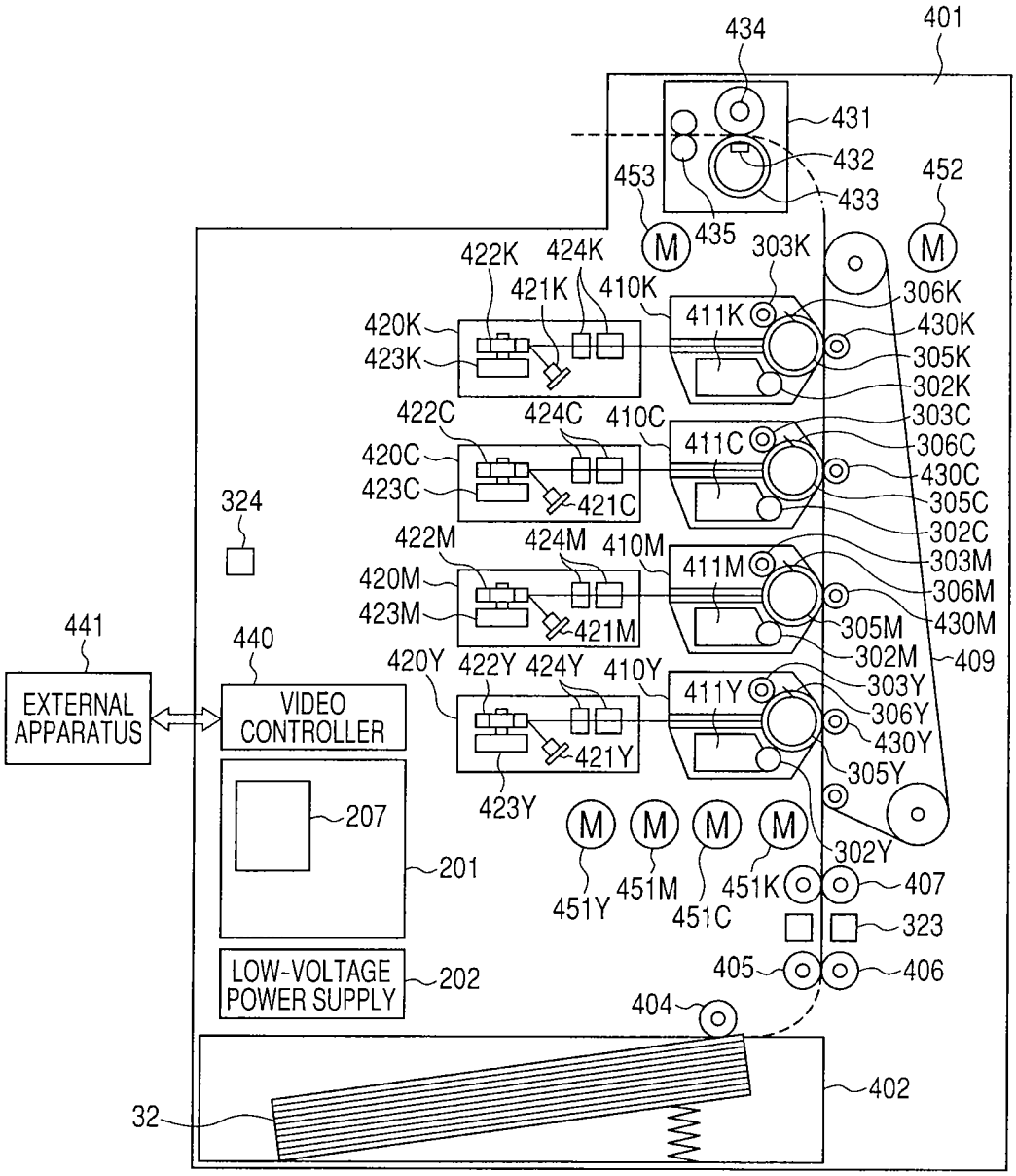
FIG. 1 is a diagram illustrating a configuration of a laser beam printer according to a first embodiment of the invention.

FIG. 1 is a diagram of the configuration of a color laser printer which is an image forming apparatus according to a first embodiment of the invention.

In a color laser printer 401, there are provided, a sheet feed cassette 402 that stores recording sheets 32, a pickup roller 404 that continuously picks up the recording sheets 32 from the sheet feed cassette 402, a feed roller 405 that conveys the recording sheets 32 successively picked up by the pickup roller 404, a retard roller 406 that forms a pair of rollers along with the feed roller 405 to prevent the double feeding of the recording sheets 32 and a registration roller pair 407.

An electrostatic-adsorption conveying transfer belt (hereinafter, referred to as "ETB") 409 conveys the recording sheets 32 by electrostatic adsorption. Process cartridges 410Y, 410M, 410C, 410K respectively include photosensitive drums 305Y, 305M, 305C, 305K, cleaning units 306Y, 306M, 306C, 306K removing toner on the photosensitive drums 305Y, 305M, 305C, 305K, charging rollers 303Y, 303M, 303C, 303K, developing rollers 302Y, 302M, 302C, 302K, and toner storage containers 411Y, 411M, 411C, 411K. Each of process cartridges 410Y, 410M, 410C, 410K can be attached to and detached from the color laser printer 401.

Scanner units 420Y, 420M, 420C, 420K respectively include laser units 421Y, 421M, 421C, 421K each of which emits a laser beam modulated based on image signals transmitted from a video controller 440. Scanner units 420Y, 420M, 420C, 420K further respectively include polygon mirrors 422Y, 422M, 422C, 422K each of which scans a corresponding one of photosensitive drums 305Y, 305M, 305C, 305K with a laser beam from the corresponding laser units 421Y, 421M, 421C, 421K, scanner motors 423Y, 423M, 423C, 423K, and focusing lens groups 424Y, 424M, 424C, 424K. Each of transfer rollers 430Y, 430M, 430C, 430K transfers a toner image from a corresponding one of photosensitive drums 305Y, 305M, 305C, 305K to a recording sheet on the ETB 409. Each of the process cartridges 410Y, 410M, 410C, 410K, the scanner units 420Y, 420M, 420C, 420K, and the transfer rollers 430Y, 430M, 430C, 430K correspond to one of four colors, yellow represented by "Y", magenta represented by "M", cyan represented by "C" and black represented by "K" in this specification. These elements constitute the image forming part forming the toner image on the recording sheet.

A fixing device (fixing part) 431 fixes the toner image formed on the recording sheet onto the recording sheet by heat and includes a heating roller 433 having a heater 432 therein, a pressure roller 434, and a fixing discharge roller pair 435 conveying the recording sheet 32 from a fixing nip portion formed between the heating roller 433 and the pressure roller 434.

DC brushless motors 451Y, 451M, 451C, 451K, 452, and 453 include main motors 451Y, 451M, 451C, 451K that respectively drive the process cartridges 410Y, 410M, 410C, 410K, an ETB motor 452 that drives the ETB, and a fixing motor 453 that drives the fixing device.

A printer controller 201 is a control unit of the laser printer 401 and includes a micro computer 207 and various input and output control circuits (not illustrated).

A low-voltage power supply circuit 202 serves to smooth and drop first AC current and to supply power to the DC brushless motors 451Y, 451M, 451C, 451K, 452, and 453 or the printer controller 201.

A video controller 440 serves to develop image data transmitted from a host computer 441 such as a personal computer in bit map data and to generate image signals for forming an image.

A basic-weight determining unit 323 applies a beam to the recording sheet and determines the basic-weight of the recording sheet using the transmitted light intensity of the recording sheet. A temperature sensor 324 senses a temperature around the image forming apparatus.

An image forming process will be described next.

First, image data is transmitted from the host computer 441 to the video controller 440. The video controller 440 transmits to the printer controller 201 a PRINT signal for instructing to start the formation of an image and converts the received image data to the bit map data. The printer controller 201 having received the PRINT signal starts driving the scanner motors 423*s* 423Y, 423M, 423C, 423K, the main motors 451Y, 451M, 451C, 451K, the ETB motor 452, and the fixing motor 453 at a predetermined timing. With the start of driving, the printer controller drives the pickup roller 404, the feed roller 405, and the retard roller 406 to successively send out the recording sheets 32 from the sheet feed cassette 402.

Power is supplied to the fixing device 431. Thereafter, the printer controller determines the thickness of the recording sheet by the use of the basic-weight determining unit 323, selects an image forming speed and an image forming condition corresponding to the recording sheet, and changes rotation speeds of the main motors 451Y, 451M, 451C, 451K, the ETB motor 452, and the fixing motor 453 when it is necessary to change the image forming speed as the determination result on the recording sheet. The printer controller senses the temperature of the image forming apparatus 401 by the use of the temperature sensor 324 and corrects the selected image forming condition according to the sensing result. The recording sheet is conveyed to and temporarily stops in the registration roller pair 407. Then, the turning ON/OFF of the laser units 421Y, 421M, 421C, 421K is controlled based on the image signals, which are based on the bit map data, to form an electrostatic image on the photosensitive drums 305Y, 305M, 305C, 305K, respectively, charged to a predetermined potential by the charging rollers 303Y, 303M, 303C, 303K, respectively, by the use of the polygon mirrors 422Y, 422M, 422C, 422K and the focusing lens group 424Y, 424M, 424C, 424K, respectively.

Thereafter, the electrostatic image is developed into a toner image by the developing rollers 302Y, 302M, 302C, 302K. The toner image forming operation is carried out in yellow (Y), magenta (M), cyan (C), and black (K) toner at predetermined timings. On the other hand, the recording sheet 32 temporarily stopped in the registration roller pair 407 is fed again to the ETB 409 at predetermined timings corresponding to the toner image forming operation, and the toner images on the photosensitive drums 305Y, 305M, 305C, 305K are sequentially transferred onto the recording sheet 32 by the transfer rollers 430Y, 430M, 430C, 430K, respectively, so as to form a color image. The color toner image formed on the recording sheet 32 is conveyed to the fixing device 431, and is heated and pressurized by the heating roller 433 heated to a predetermined temperature and the pressure roller 434 to be fixed to the recording sheet, and the recording sheet is discharged from the image forming apparatus 401 by the fixing discharge roller pair 435.

Figure 2:
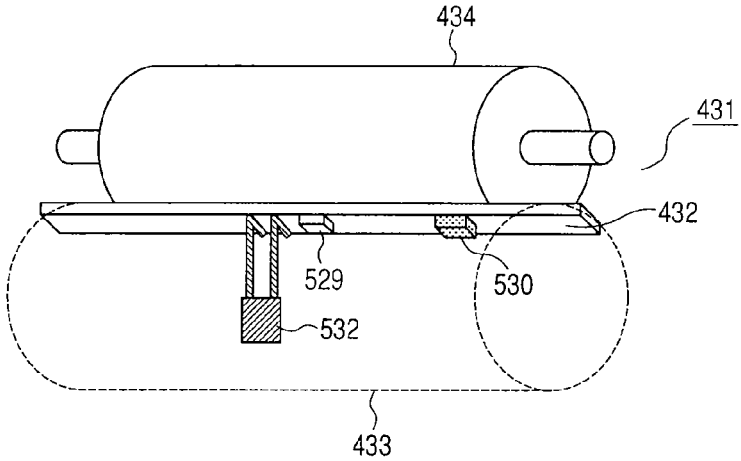
FIG. 2 is a diagram more specifically illustrating a fixing device according to the first embodiment.
Figure 3:
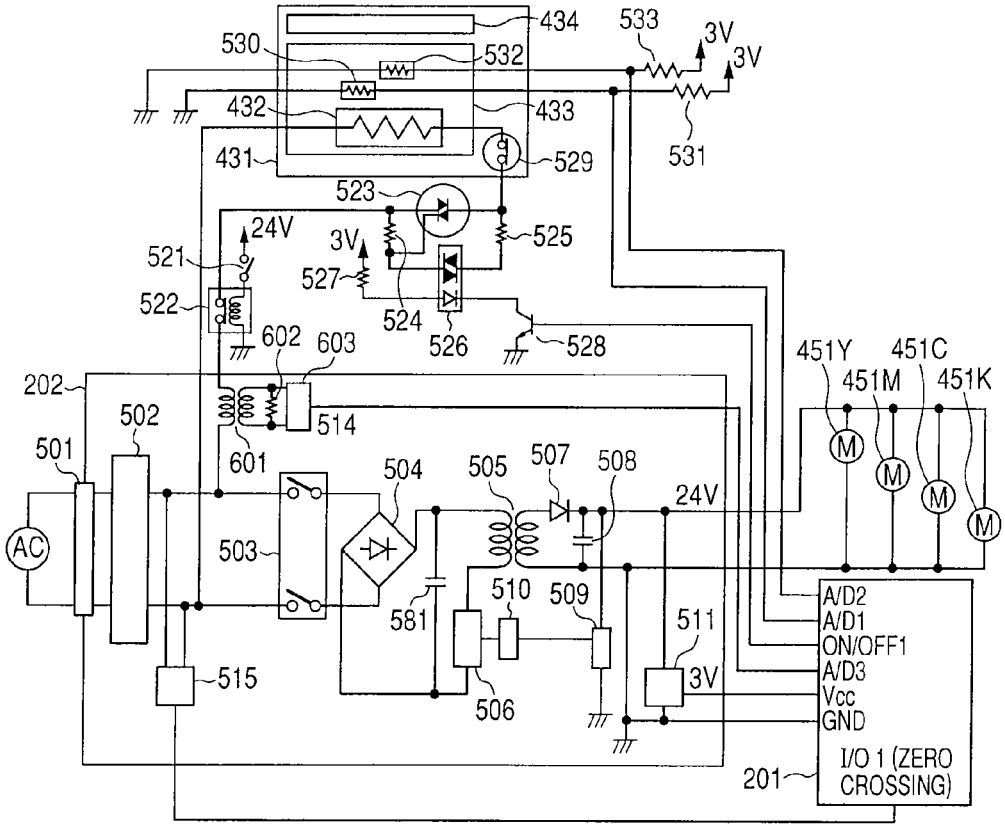
FIG. 3 is a diagram illustrating a temperature control circuit of the fixing device according to the first embodiment.

FIG. 2 is a diagram more specifically illustrating the fixing device (fixing part) according to this embodiment. FIG. 3 is a diagram illustrating a temperature control operation of the fixing device according to this embodiment. FIGS. 4A to 4D are diagrams illustrating fixing current waveforms supplied to the heater of the fixing device. In FIG. 2, the fixing device 431, the heater 432, the heating roller 433, and the pressure roller 434 are shown. The heating roller 433 according to this embodiment is an endless belt having flexibility. A thermo switch 529 stops the supply of power to the fixing device when the temperature of the heater 432 is greater than a predetermined temperature. A heater-backside thermistor 530 contacts an end in the longitudinal direction of the heater 432. A thermistor 532 contacting the roller-inside contacts the inside of the heating roller 433 in the vicinity of the center in the longitudinal direction of the heating roller 433. The heating roller 433 and the heater 432 constitute a heating unit, and a fixing nip portion for conveying the recording sheet is formed by bringing the pressure roller 434 into contact with the heating unit. More specifically, the heating unit includes an endless belt 433 and a heater 432 contacting the inside surface of the endless belt and forms the fixing nip portion by the use of the heater 432 and the pressure roller 434 with the endless belt 433 interposed therebetween.

In FIG. 3, a low-voltage power supply 202 and an inlet 501 are provided. An AC filter 502 removes noise from a commercial power supply and noise from the low-voltage power supply. A main switch 503 and a diode bridge 504 are provided. A converter 505 generates a voltage of 24 V. A converter control circuit 506, a diode 507, a capacitor 508, a static-voltage control circuit 509, and a photocoupler 510 are provided. A DC/DC converter 511 generates a voltage of 3 V from the voltage of 24 V. A current transformer 601, a resistor 602, an effective current sensing circuit 603, and a zero-cross sensing circuit 515 are provided.

An interlock switch 521 is opened and closed by interlocking with a door of the image forming apparatus. A relay 522, a triac 523, resistors 524, 525, and 527, a phototriac coupler 526, and a transistor 528 are provided. The fixing device 431, the heating roller 433, the pressure roller 434, the heater 432, and a thermo switch 529 are provided. The heater-backside thermistor 530 contacts the end of the heater 432. The thermistor 532 contacting the roller-inside contacts the inside of the heating roller 433 in the vicinity of the center of a longitudinal direction of the heating roller 433. Resistors 531 and 533 are provided.

The temperature control operation of the fixing device will be described with reference to FIG. 3 and FIGS. 4A to 4D.

When the main switch 503 is turned on, commercial current flows through the inlet 501 and the AC filter 502 and is rectified in full waves by the diode bridge 504 and the capacitor 581. The converter 505 is switched by the converter control circuit 506 and pulsating current is excited in the secondary side of the converter 505. The pulsating current is rectified by the diode 507 and the capacitor 508.

The rectified voltage is sensed by the static voltage control unit 509 and the converter control circuit 506 is controlled via the photocoupler 510 so as to be constant (24 V in this embodiment). The rectified voltage of 24 V is supplied to the DC brushless motor 451 and the DC/DC converter 511 to generate 3 V. The generated 3 V is supplied to the printer controller 201 and is used to control the image forming apparatus 401.

Figures 4A, 4B, 4C, 4D:
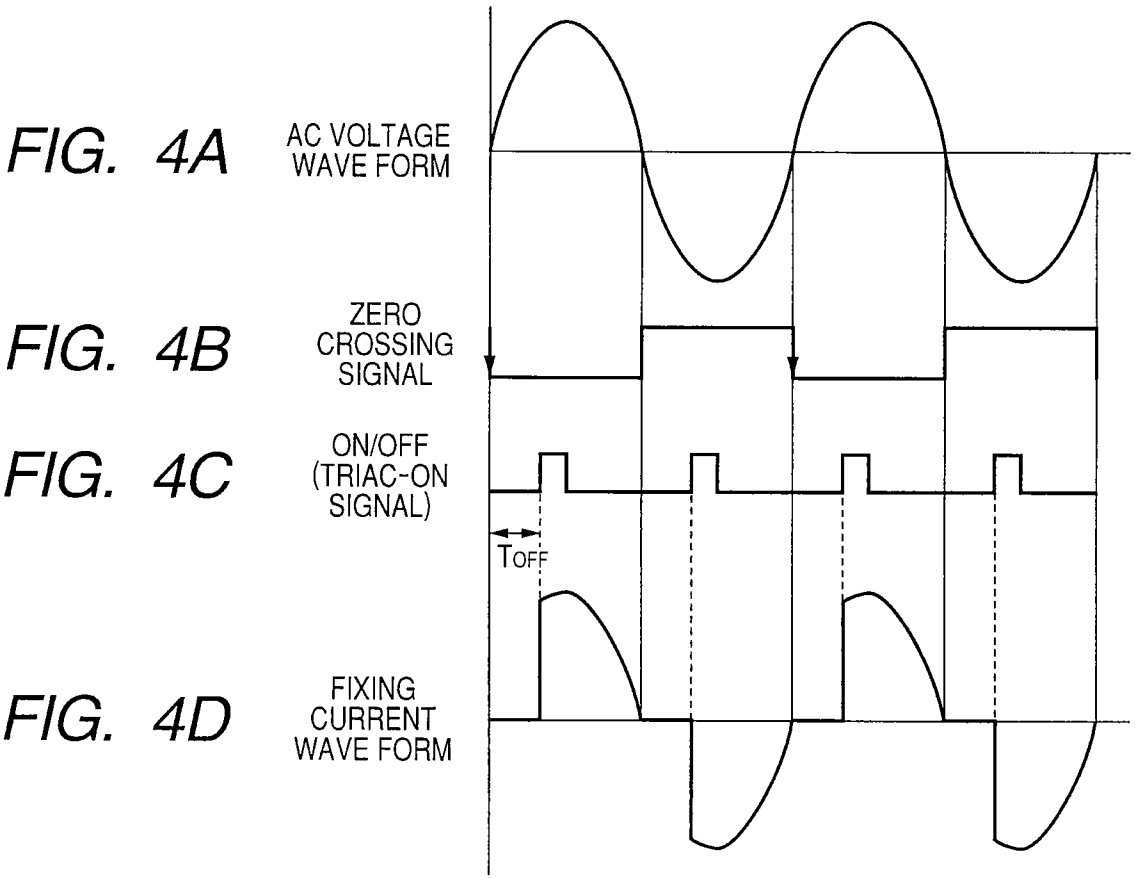
FIGS. 4A, 4B, 4C and 4D are diagrams illustrating fixing current waveforms in the first embodiment.

The printer controller 201 senses the divided voltages of the heater-backside thermistor 530 and the resistor 531 via an A/D1 port. The divided voltages of the thermistor contacting the roller-inside 532 and the resistor 533 are sensed via an A/D2 port. The thermistor has a characteristic that the resistance decreases with an increase in temperature, and the printer controller 201 detects the temperature of the heater 432 from the divided voltage of the A/D1 port and detects the temperature of the heating roller 433 from the divided voltage of the A/D2 port. As illustrated in the AC voltage waveform of FIG. 4A, the heater 432 of the fixing device 431 is supplied with a commercial power (electric power) via the relay 522, the triac 523, and the thermo switch 529 (FIG. 4A). The printer controller 201 senses the time at which the sign of the commercial power is inverted, that is, a so-called zero crossing signal, via a zero crossing sensing circuit 515 (FIG. 4B). In a predetermined time period after the zero crossing signal is sensed (hereinafter, referred to as "$T_{OFF}$"), a triac-ON signal is output from an ON/OFF1 port to turn on the transistor 528 (FIG. 4C). When the transistor 528 is turned on, current flows in the phototriac coupler 526 via the resistor 527 and thus the phototriac coupler 526 is turned on. When the phototriac coupler 526 is turned on, current flows in the triac 523 via the resistors 524 and 525 and thus the triac 523 is turned on. When the triac 523 is turned on, current having the fixing current waveform illustrated in FIG. 4D flows in the heater 432 and thus the heater 432 emits heat (FIG. 4D).

The amount of heat emitted from the heater 432 is expressed by $W=[Iforms]^2 \times Rf$, where Iforms is the effective current (hereinafter, referred to as "fixing current") flowing in the heater 432 and Rf is the resistance value (specification value) of the heater 432. The triac 523 is turned off when the gate current is zero, that is, at the next zero cross timing. At the time of forming an image when the heating roller 433 is rotating, the printer controller 201 controls the fixing current using $T_{OFF}$ to control the amount of heat emitted from the heater 432 and to keep the sensed temperature of the heating roller 433 constant (at the control target temperature) via the A/D2 port. On the other hand, the temperature of the heater 432 is monitored via the A/D1 port and the relay 522 is controlled so that the temperature of the heater 432 is not higher than a predetermined temperature (a temperature higher than the control target temperature), thereby performing a protecting operation. As described above, the printer controller (controller) 201 controls the power supplied to the heater 432 (the power supplied to the heating unit) so as to keep the temperature of the heating roller 433 (the temperature of the heating unit) at the control target temperature.

The temperature control of the fixing device in the standby-mode according to this embodiment will be described now. The standby-mode is a mode into which the apparatus is switched when a new image is not formed after performing a fixing process on a recording sheet bearing a toner image. In the standby-mode, the printer controller (controller) 201 sets the control target temperature to a temperature lower than the temperature in the fixing process so as to control the supply of power to the heater 432, while waiting for an image forming request (PRINT signal) from the video controller 440. When the image forming request (PRINT signal) is transmitted from the video controller 440 to the printer controller (controller) 201 in the standby-mode, the control target temperature is switched to the control target temperature in the fixing process at that time, thereby controlling the supply of power to the heater 432. In this embodiment, the power is supplied to the heater 432 in the standby-mode so as not to cool the fixing device excessively, but the heating roller 433 and the pressure roller 434 are stopped in rotation in the standby-mode so as to suppress the deterioration in durability of the heating roller 433 and the pressure roller 434. However, rotation control may be added to the standby-mode.

As described in detail below, in this embodiment, even when the formation of an image is finished and the temperature of the heating unit is lowered to the control target temperature in the standby-mode by intercepting the supply of power to the heating unit, the supply of power is not started at once, but the supply of power in the standby-mode is not started until the temperature of the heating unit is lowered to a predetermined temperature lower than the control target temperature in the standby-mode. That is, when the fixing process is finished and the supply of power to the heating unit is started in the standby-mode so as to keep the temperature of the heating unit at the control target temperature in the standby-mode, the start time of the supply of power to the heating unit is set to the time when the temperature of the heating unit is lowered to the predetermined temperature lower than the control target temperature in the standby-mode. Accordingly, it is possible to reduce the power consumption in the standby-mode without wasting the time period (FPOT) until the recording sheet is discharged after the image forming request is input.

Figure 5:
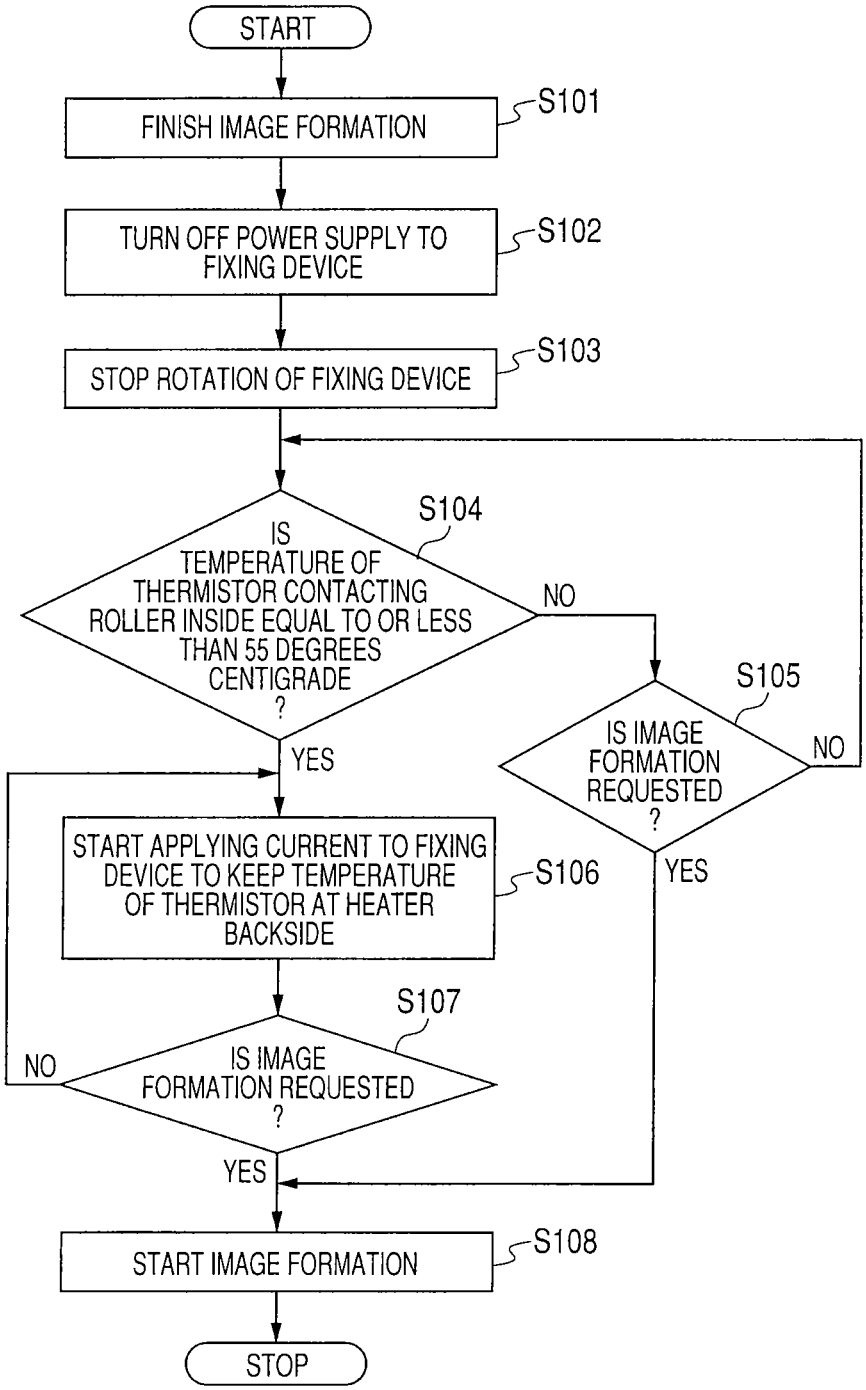
FIG. 5 is a flowchart illustrating an image forming operation according to the first embodiment.
Figure 6:
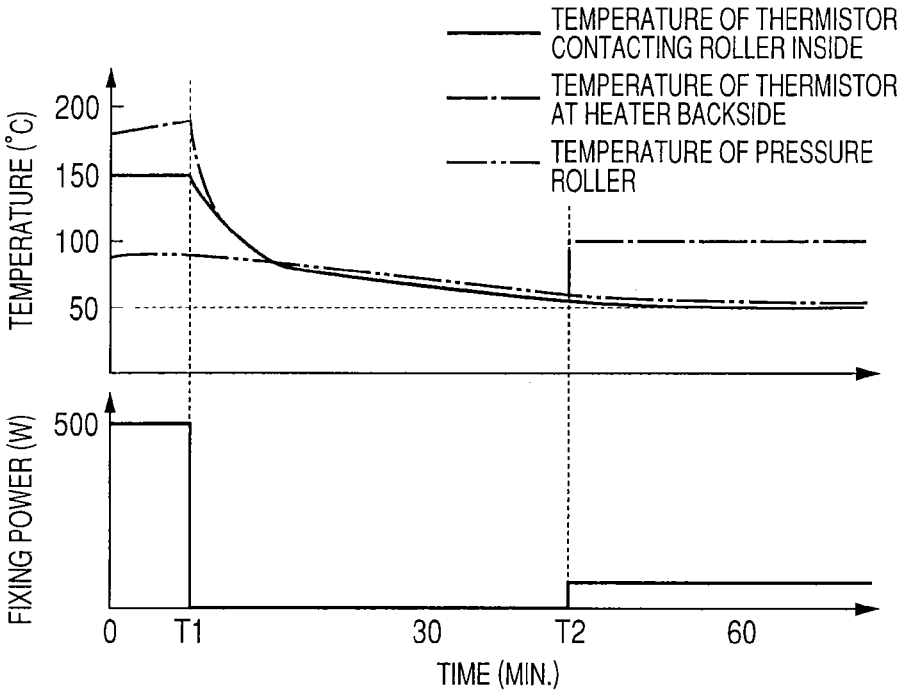
FIG. 6 is a diagram illustrating a temperature and fixing power of the fixing device after performing a printing operation according to the first embodiment.
Figure 7:
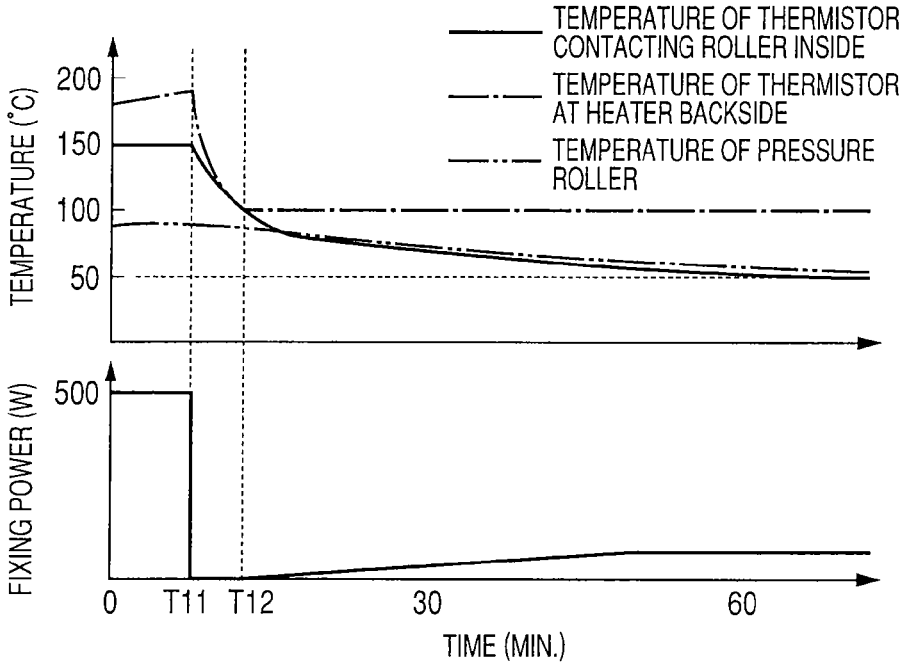
FIG. 7 is a diagram illustrating the temperature and the fixing power of the fixing device after performing a printing operation according to the related art.

FIG. 5 is a flowchart illustrating the image forming operation according to this embodiment and FIG. 6 is a diagram illustrating the temperature and the fixing power of the fixing device 431 after 60 sheets of regular paper with a size of A4 are subjected to a printing operation at room temperature. The temperature of the pressure roller illustrated in FIG. 6 is a temperature experimentally measured to exhibit the advantage of this embodiment without providing the image forming apparatus with any sensing unit thereof in this embodiment. At the time of performing a printing operation on a regular sheet (at the time of performing a fixing operation) in this embodiment, the thermistor contacting the roller-inside 532 maintains the control target temperature (150° C.) to perform fixing control. In FIG. 6, the part prior to time T1 is the print mode and the part posterior to time T1 is the standby-mode. In FIG. 7 to be described later, the part prior to time T11 is the print mode and the part posterior to time T11 is the standby-mode.

When an image formation operation is finished in step S101, the supply of power to the fixing device 431 is stopped in step S102 and the rotation of the fixing device 431 is stopped in step S103. Thereafter, in steps S104 and S105, the supply of power to the fixing device is continuously stopped until the temperature of the thermistor contacting the roller-inside 532 is equal to or lower than a pre-heating start temperature (a predetermined temperature lower than the control target temperature in the standby-mode, for example, 55° C. in this embodiment) or until a next image forming request is received. When the supply of power to the heater is stopped until the temperature of the thermistor 532 is equal to or lower than 55° C., the temperature of the fixing device 431 falls, the temperatures of the elements are almost the same at time T2 (FIG. 6), and then the temperatures fall in the same way. This is because the temperature of the fixing device 431 depends on the temperature of the pressure roller 434 having the greatest heat capacity. In this embodiment, the temperature of the thermistor contacting the roller-inside 532 is compared with the pre-heating start temperature, but the heater-backside thermistor 530 may be compared with the pre-heating start temperature. That is, the temperature of the heating unit can be compared with the pre-heating start temperature.

In another experiment in the image forming apparatus according to this embodiment, it can be seen that it is necessary to warm the pressure roller to 50° C. or higher so that the temperature of the thermistor contacting the roller-inside 532 reaches the control target temperature (150° C. in this embodiment) in the fixing process within a predetermined time period (FPOT in a product catalog) necessary for starting up the fixing process and determined in the printing procedure. As can be seen from FIG. 6, when the sensed temperature of the thermistor contacting the roller-inside 532 or the sensed temperature of the heater-backside thermistor 530 is lowered to the control target temperature 100° C. in the standby-mode, the temperature of the pressure roller 434 is much higher than 50° C. Accordingly, even when the sensed temperature of the thermistor contacting the roller-inside 532 or the sensed temperature of the heater-backside thermistor 530 falls lower than the control target temperature 100° C. in the standby-mode, a period of time where the temperature of the pressure roller is kept equal to or higher than 50° C. exists. In this embodiment, the supply of power to the heater is not started in this period. When the temperature of the thermistor contacting the roller-inside 532 is equal to or lower than the pre-heating start temperature (55° C.) in step S104, the supply of power to the fixing device 431 is started in step S106 and the temperature of the heater-backside thermistor 530 is kept at the pre-heating temperature (the control target temperature in the standby-mode, for example, 100° C. in this embodiment). As a result, the amount of heat emitted from the fixing device 431 is balanced with the amount of heat supplied from the heater 432 and the temperature of the pressure roller 434 is kept at 50° C.

When an image forming request is received in steps S105 and S107, the formation of an image is started in step S108 and the temperature control of the fixing device in the standby-mode is ended.

The reason for using the sensed temperature of the heater-backside thermistor 530 without using the sensed temperature of the thermistor contacting the roller-inside 532 to keep the heating unit at the pre-heating temperature in step S106 is to prevent the concentration deviation at the time of forming an image and to prevent the thermal deterioration of the heating roller 433 and the pressure roller 434. As described above, in the fixing device according to this embodiment, the heating roller and the pressure roller are stopped in rotation in the standby-mode. A thermal time constant between the heater 432 and the thermistor contacting the roller-inside 532 is great in the state where the rotation of the fixing device 431 is stopped, and the pressure roller 434 is partially heated excessively when the heater 432 is controlled depending on the temperature of the thermistor contacting the roller-inside 532. When the pressure roller 434 is partially heated excessively, a temperature deviation occurs in the circumferential direction of the heating roller 433 and the pressure roller 434 and a concentration deviation occurs at the time of forming an image. Thus, the heating roller 433 and the pressure roller 434 thermally deteriorate. Accordingly, in the standby-mode in which the rotation is stopped, the supply of power to the heater is controlled using the sensed temperature of the heater-backside thermistor 530 so as not to heat the pressure roller 434 excessively. However, when the rotation control is performed in the standby-mode or when there is no possibility of heating the pressure roller excessively, the supply of power to the heater may be controlled using the sensed temperature of the thermistor contacting the roller-inside 532.

The time when the formation of an image is finished is T1 and the time when the temperature of the thermistor contacting the roller-inside 532 is equal to or lower than the pre-heating start temperature (55° C.) is T2, the time period from T1 to T2 depends on the temperature of the pressure roller 434 at the timing of ending the image forming process, which is about 40 minutes in this experiment.

FIG. 7 illustrates the temperature and the fixing power of the fixing device 431 after 60 sheets of regular paper with a size of A4 are continuously subjected to a printing operation at a room temperature in the related art. At time T11, the formation of an image is finished and the supply of power to and the rotation of the fixing device 431 are stopped. Thereafter, since the temperature of the heater-backside thermistor 530 reaches 100° C. which is the control target temperature in the standby-mode at time T12, the supply of power to the fixing device 431 is restarted to keep the temperature of the heater-backside thermistor 530 at 100° C. However, thereafter, the temperatures of the thermistor contacting the roller-inside 532 and the pressure roller 434 are slowly lowered, the amount of heat supplied from the heater 432 and the amount of heat emitted from the fixing device 431 are balanced with each other in about 60 minutes after the formation of an image is finished (T11), and the thermistor contacting the roller-inside 532 is kept at about 50° C.

The time period from T11 to T12 depends greatly on the temperature of the pressure roller 434 at the timing of finishing the formation of an image, which is about 5 minutes in this experiment.

As can be seen by comparing the fixing powers illustrated in FIGS. 6 and 7 (the power supplied to the heater 432), according to this embodiment, it is possible to reduce the power consumption of the image forming apparatus in the standby-mode without sacrificing the FPOT.

As described above, in this embodiment, even when the formation of an image is finished and the temperature of the heating unit is lowered to the control target temperature in the standby-mode by intercepting the supply of power to the heating unit, the supply of power is not started at once, but the supply of power in the standby-mode is not started until the temperature of the heating unit is lowered to a predetermined temperature lower than the control target temperature in the standby-mode. This control is particularly effective for the configuration in which the heating unit includes the endless belt and the heater contacting the inside surface of the endless belt and the fixing nip portion is formed by the heater and the pressure roller with the endless belt interposed therebetween, like the fixing device according to this embodiment. This heating unit is much smaller in heat capacity than the pressure roller. Accordingly, when the fixing process is finished and the supply of power to the heater is stopped, the temperature of the heating unit is lowered more rapidly than that of the pressure roller, but there exists a period of time where the pressure roller is sufficiently warm. When this embodiment is applied to the configuration in which the fixing nip portion is formed by the pressure roller and a heating unit having a heat capacity much smaller than that of the pressure roller, and the temperature of the heating unit having the small heat capacity is monitored to manage the temperature of the fixing device, it is particularly advantageous.

Second Embodiment

A second embodiment of the invention is based on the assumption of an image forming apparatus which is switched from the standby-mode to a power saving mode when the time period after the printing operation is ended reaches a predetermined time period. In the power saving mode, the printer controller (controller) 201 completely shuts off the supply of power to the heater 432 while waiting for the image forming request (PRINT signal) from the video controller 440. When the image forming request (PRINT signal) is transmitted from the video controller 440 to the printer controller (controller) 201 in the power saving mode, the control target temperature is switched to the control target temperature at the time of performing the fixing process to control the supply of power to the heater 432. However, unlike the case where the image forming request is transmitted in the standby mode, the FPOT does not often occur within a predetermined time period even when the image forming request is transmitted in the power saving mode. That is, the power saving mode is a mode where the FPOT does not satisfy the catalog specification, but the power consumption is suppressed as much as possible.

In this embodiment, the time remaining (=the remaining time period in the standby-mode) until the apparatus is switched to the "power saving mode where the pre-heating of the fixing device is not performed" is compared with the temperature falling time period of the thermistor contacting the roller-inside before performing the pre-heating in the standby-mode. When it is determined that the temperature of the thermistor contacting the roller-inside can be kept at a predetermined temperature (55° C.) or higher without pre-heating the fixing device until the apparatus is switched to the power saving mode, the pre-heating is not performed. The reason for performing this control is because a state where the inside is warm and a state where only the surface is warm exist even when the surface temperature of the pressure roller is constant at the time of finishing the printing operation. When the inside of the pressure roller is satisfactorily warm, the temperature falling speed of the pressure roller after the printing operation is finished and the supply of power to the heater is stopped is slow and the start of the pre-heating operation in the standby-mode is slowed by as much, thereby reducing the power consumption.

Figure 8:
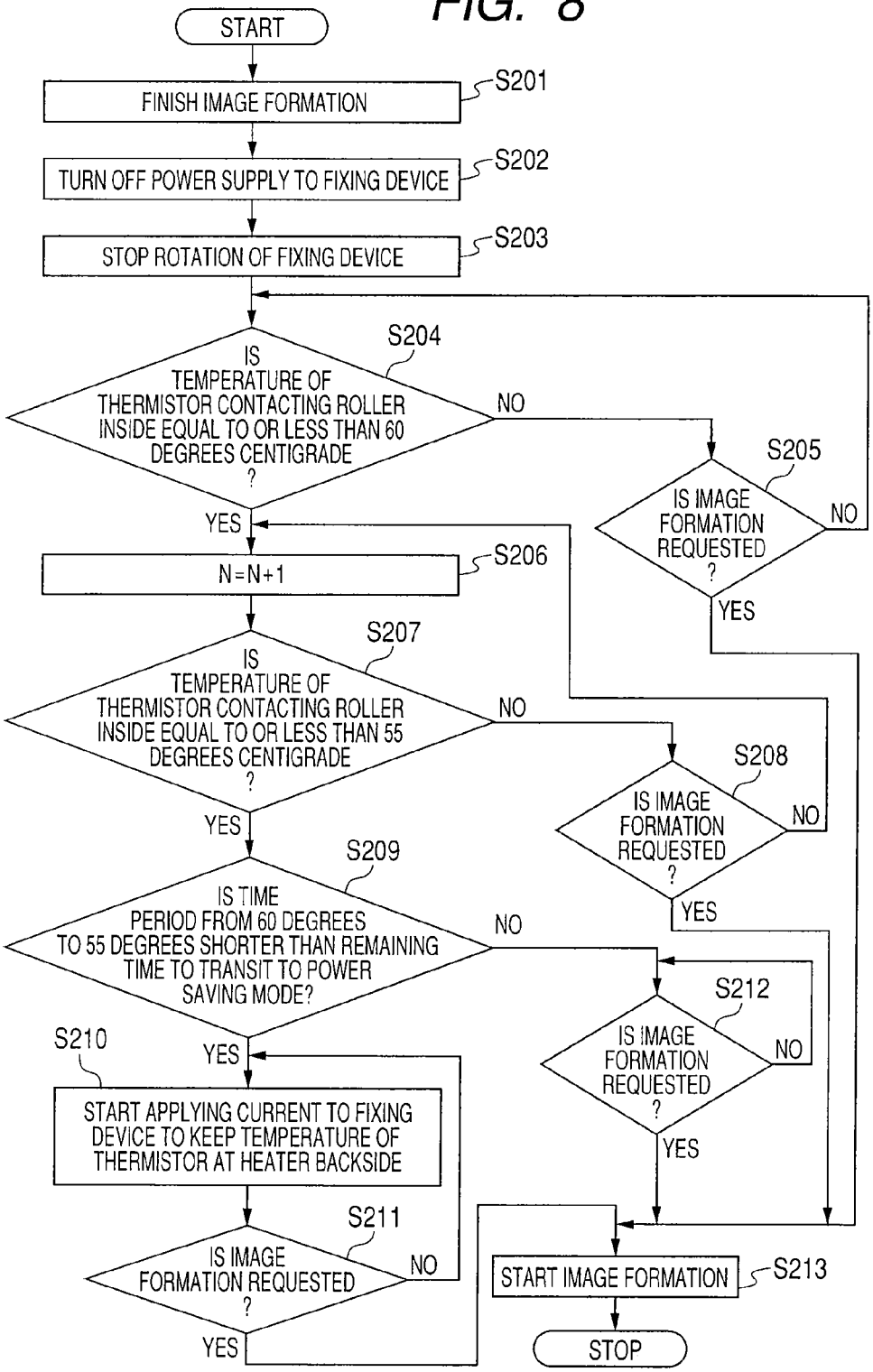
FIG. 8 is a flowchart illustrating an image forming operation according to a second embodiment of the invention.

FIG. 8 is a flowchart illustrating the image forming operation according to this embodiment. The configurations of the image forming apparatus and the fixing device and the temperature control operation of the fixing device are the same as the first embodiment and thus a description thereof is not repeated.

When the formation of an image is finished in step S201, the supply of power to the fixing device 431 is stopped in step S202 and the rotation of the fixing device 431 is stopped in step S203. Thereafter, in steps S204 and S205, the supply of power to the fixing device is continuously stopped until the temperature of the thermistor contacting the roller-inside 532 is equal to or lower than a measurement start temperature (a predetermined first temperature, for example, 60° C. in this embodiment) of the temperature falling time period or until a next image forming request is received. When the temperature of the thermistor contacting the roller-inside reaches the measurement start temperature 60° C. of the temperature falling time period in step S204, the time until the temperature of the thermistor contacting the roller-inside reaches the per-heating start temperature (a predetermined second temperature 55° C. in this embodiment) from the measurement start temperature 60° C. of the temperature falling time period is counted in steps S206 to S208 (where N in step S206 denotes the time count value).

When the temperature of the thermistor contacting the roller-inside reaches the pre-heating start temperature 55° C. in step S207, the remaining time period Tb until the apparatus is switched to the power saving mode is compared in step S209 with the measurement time period Ta until the temperature of the thermistor contacting the roller-inside reaches the pre-heating start temperature 55° C. from the measurement start temperature 60° C. of the temperature falling time period. When Ta<Tb, the supply of power to the fixing device 431 is started in step S210, and the supply of power to the heater is controlled so as to keep the temperature of the heater-backside thermistor 530 at the pre-heating temperature (100° C. in this embodiment). As a result, the amount of heat supplied from the heater 432 is balanced with the amount of heat emitted from the fixing device 431 and the temperature of the pressure roller 434 is kept at 50° C. On the other hand, when Ta≥Tb, the supply of power to the fixing device 431 is not made and the image forming request or an instruction for switching to the power saving mode is waited for in step S212.

When the image forming request is received in steps S205, S208, and S212, the formation of an image is started in step S213 and the fixing device temperature control in the standby-mode is finished.

According to this embodiment, when the remaining time period until the apparatus is switched to the "power saving mode" is small, it is possible to prevent the unnecessary pre-heating and to further reduce the power consumption of the image forming apparatus in the standby-mode.

Third Embodiment

In a third embodiment of the invention, the temperature falling time period of the thermistor contacting the roller-inside before the pre-heating in the standby-mode is sensed and the temperature of the thermistor contacting the roller-inside on which the pre-heating is performed is changed when the temperature falling time period is equal to or smaller than a predetermined time period.

Figure 9:
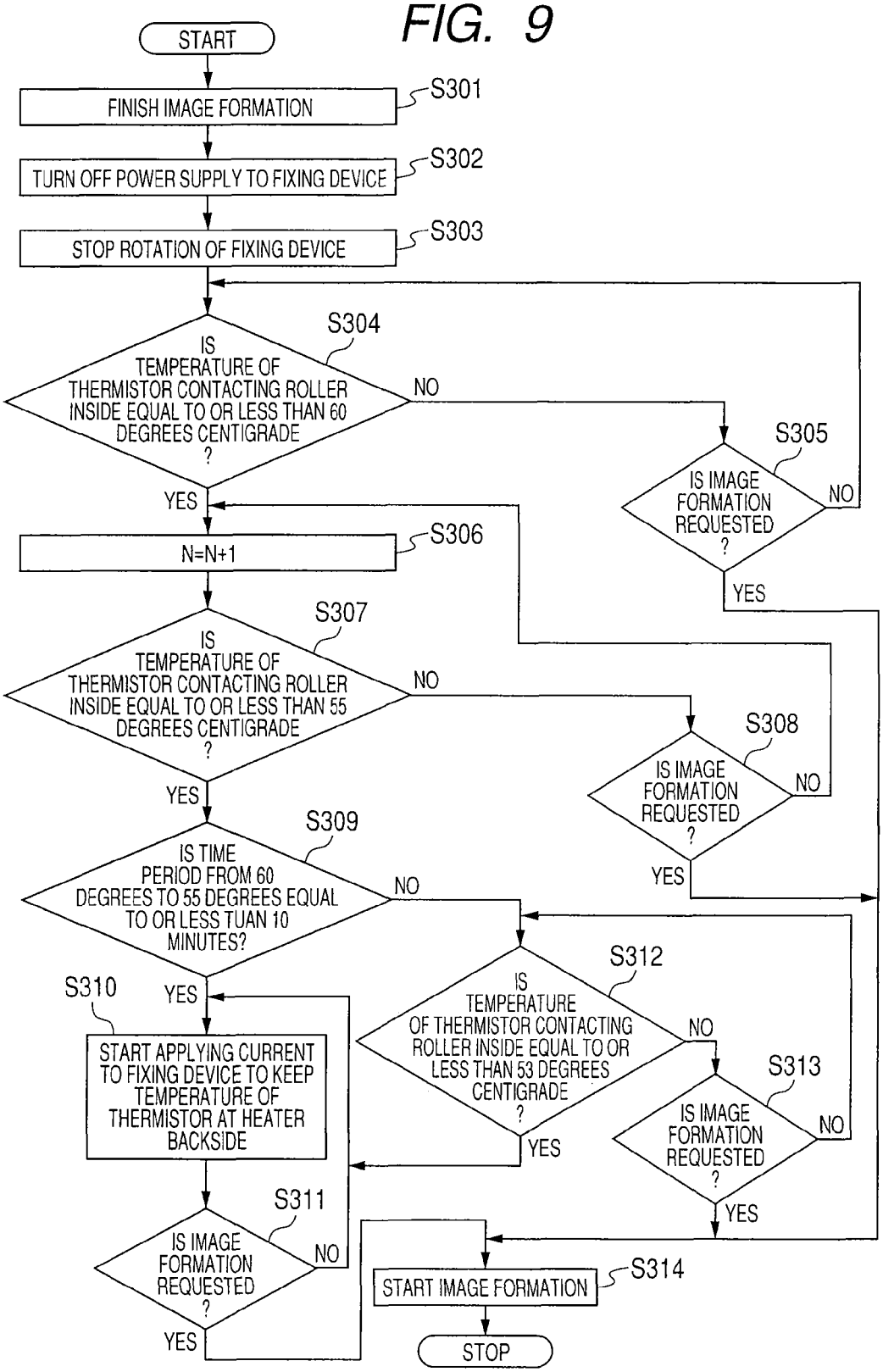
FIG. 9 is a flowchart illustrating an image forming operation according to a third embodiment of the invention.

FIG. 9 is a flowchart illustrating the image forming operation according to this embodiment. The configurations of the image forming apparatus and the fixing device and the temperature control operation of the fixing device are the same as the first embodiment and thus description thereof is not repeated.

When the formation of an image is finished in step S301, the supply of power to the fixing device 431 is stopped in step S302 and the rotation of the fixing device 431 is stopped in step S303. Thereafter, in steps S304 and S305, the supply of power to the fixing device is continuously stopped until the temperature of the thermistor contacting the roller-inside 532 is equal to or lower than a measurement start temperature (60° C. in this embodiment) of the temperature falling time period or until a next image forming request is received. When the temperature of the thermistor contacting the roller-inside reaches the measurement start temperature 60° C. of the temperature falling time period in step S304, the time period until the temperature of the thermistor contacting the roller-inside reaches the per-heating start temperature 55° C. from the measurement start temperature 60° C. of the temperature falling time period is counted in steps S306, S307, and S308.

When the temperature of the thermistor contacting the roller-inside reaches the pre-heating start temperature 55° C. in step S307, the measurement time period Tc until the temperature of the thermistor contacting the roller-inside reaches the pre-heating start temperature 55° C. from the measurement start temperature 60° C. of the temperature falling time period is compared with a predetermined time period (10 minutes in this embodiment) in step S309. When Tc<10 minutes, the supply of power to the fixing device 431 is started in step S310, to keep the temperature of the heater-backside thermistor 530 at the pre-heating temperature (100° C. in this embodiment). That is, the pre-heating is started when the temperature of the thermistor contacting the roller-inside temperature is 55° C. As a result, the amount of heat supplied from the heater 432 is balanced with the amount of heat emitted from the fixing device 431 and the temperature of the pressure roller 434 is kept at 50° C. On the other hand, when Tc≥10 minutes, the supply of power to the fixing device 431 is not made and it is waited for in steps S312 and S313 until the temperature of the thermistor contacting the roller-inside 532 is equal to or lower than a second pre-heating start temperature (53° C. in this embodiment). In this way, in this embodiment, the predetermined temperature (pre-heating start temperature) is set depending on the temperature falling speed of the heating unit after the apparatus is switched to the standby-mode.

When the temperature of the thermistor contacting the roller-inside 532 is equal to or lower than the second pre-heating start temperature (53° C.) in step S312, the supply of power to the fixing device 431 is started in step S310 and the supply of power to the heater is controlled to keep the heater-backside thermistor 530 at the pre-heating temperature (100° C.).

When the image forming request is received in steps S305, S308, and S313, the formation of an image is started in step S314 and the fixing device temperature control in the standby-mode is finished.

According to this embodiment, when the amount of heat emitted from the fixing device is small or when the fixing device (particularly, the pressure roller) is satisfactorily warm at the timing of finishing the printing operation (when Tc≥10 minutes), it is possible to lower the temperature of the pressure roller at which the pre-heating is started and to further reduce the power consumption of the image forming apparatus in the standby-mode.

In the first to third embodiments, the temperature at which the pre-heating operation is started in the standby-mode is determined using the temperature of the thermistor contacting the roller-inside. However, the temperature at which the pre-heating operation is started in the standby-mode may be determined using the temperature of the heater-backside thermistor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-037778, filed Feb. 20, 2009, and Japanese Patent Application No. 2010-022100, filed Feb. 3, 2010 which are hereby incorporated by reference herein in their entirety.

What is claimed is:

1. An image forming apparatus comprising:

an image forming part that forms a toner image on a recording sheet;

a fixing part that heats the toner image formed on the recording sheet to fix the toner image onto the recording sheet, said fixing part including a heating unit and a pressure roller that comes in contact with said heating unit to form a fixing nip portion through which the recording sheet is conveyed; and a controller that controls power to be supplied to said heating unit so as to keep a temperature of said heating unit at a control target temperature, wherein in a case where a new image is not formed after a fixing process is performed for the recording sheet bearing the toner image, said image forming apparatus switches to a standby mode to wait for a request for an image forming operation, wherein after finishing the fixing process, said image forming apparatus switches from the standby mode to a power saving mode where power consumption of said image forming apparatus is lower than power consumption in the standby mode, and said controller changes control of power supplied to said heating unit until said image forming apparatus switches to the power saving mode according to a temperature falling speed of said heating unit after said image forming apparatus is switched to the standby mode.

2. An image forming apparatus according to claim 1, wherein the necessary time period for lowering the temperature of said heating unit from a first temperature to a second temperature lower than the first temperature is denoted as Ta after said image forming apparatus is switched to the standby mode, wherein the remaining time period from the time when the temperature of said heating unit is lowered to the second temperature to the time when the image forming apparatus is switched to the power saving mode is denoted as Tb, wherein in a case where Ta is smaller than Tb, said controller supplies the power to said heating unit so as to keep the temperature of said heating unit at the control target temperature in the standby mode until said image forming apparatus is switched to the power saving mode, and in a case where Ta is equal to or greater than Tb, said controller does not supply the power to said heating unit in the standby mode and waits for an instruction to switch to the power saving mode.

3. An image forming apparatus according to claim 1, wherein said heating unit includes an endless belt and a heater that contacts an inside surface of said endless belt, and wherein the fixing nip portion is formed by said heater and said pressure roller with said endless belt interposed therebetween.

4. An image forming apparatus according to claim 3, wherein said controller controls the supply of power to said heating unit in the fixing process so that the temperature of said endless belt is maintained at the control target temperature, and controls the supply of power to said heating unit in the standby mode so that the temperature of said heater is maintained at the control target temperature.

5. An image forming apparatus according to claim 4, wherein said endless belt and said pressure roller are stopped in rotation in the standby mode.

6. An image forming apparatus comprising:

an image forming part that forms a toner image on a recording sheet;

a fixing part that heats the toner image formed on the recording sheet to fix the toner image onto the recording sheet, said fixing part including a heating unit and a pressure roller that comes in contact with said heating unit to form a fixing nip portion through which the recording sheet is conveyed; and a controller that controls power to be supplied to said heating unit so as to keep a temperature of said heating unit at a control target temperature, wherein said image forming apparatus switches to a standby mode to wait for a request for an image forming operation after a fixing process is finished, and said controller controls the supply of power to said heating unit in the standby mode so that the temperature of said heating unit is maintained at the control target temperature in the standby mode, and wherein a temperature at a time when power is started to be supplied to said heating unit after switching to the standby mode is set in accordance with a temperature falling speed of said heating unit after said fixing process is finished.

7. An image forming apparatus according to claim 6, wherein said heating unit includes an endless belt and a heater for heating said endless belt, and wherein the fixing nip portion is formed between said endless belt and said pressure roller.

8. An image forming apparatus according to claim 7, wherein said controller controls the supply of power to said heating unit in the standby mode so that the temperature of said heater or the temperature of said endless belt is maintained at the control target temperature in the standby mode.

9. An image forming apparatus according to claim 8, wherein said endless belt and said pressure roller are stopped in rotation in the standby mode.

10. An image forming apparatus according to claim 6, wherein when the temperature falling speed is higher than a predetermined value, the start time of the supply of power to said heating unit is set to a time when the temperature of said heating unit is lowered to a first predetermined temperature lower than the control target temperature in the standby mode, and when the temperature falling speed is lower than the first predetermined value, the start time of the supply of power to said heating unit is set to the time when the temperature of said heating unit is lowered to a second predetermined temperature lower than the first predetermined temperature in the standby mode.

* * * * *